United States Patent [19]

Link

[11] 4,370,935

[45] Feb. 1, 1983

[54] WALL SAFE AND DOOR HINGING MEANS THEREFOR

[76] Inventor: Lawrence R. Link, 3105 Tremont Dr., Louisville, Ky. 40205

[21] Appl. No.: 167,833

[22] Filed: Jul. 14, 1980

[51] Int. Cl.[3] ..... E05G 1/04

[52] U.S. Cl. ..... 109/51; 109/74

[58] Field of Search ..... 109/50, 51, 52, 64, 109/74, 78, 79, 85

[56] References Cited

U.S. PATENT DOCUMENTS

| | | | |
|---|---|---|---|
| 264,172 | 9/1882 | Laskey | 109/50 |
| 454,162 | 6/1891 | Baum | 109/79 |
| 1,023,425 | 4/1912 | Harrison | 109/50 |
| 1,644,410 | 10/1927 | Belknap | 109/53 |
| 1,796,502 | 3/1931 | Boucher | 109/51 |
| 3,408,966 | 11/1968 | Gartner | 109/74 |
| 3,683,827 | 8/1972 | Enright | 109/50 |
| 4,043,279 | 8/1977 | Padgett | 109/50 |

*Primary Examiner*—Reinaldo P. Machado
*Attorney, Agent, or Firm*—Maurice L. Miller, Jr.

[57] ABSTRACT

A wall safe including a rectangular box adapted to fit relatively closely between adjacent wall studs of a building and having a boltless rectangular shaped face plate attached to a front surface of the box which has projecting edge portions extending beyond the sides of the box across or nearly across the front edge of the wall studs is disclosed. The box contains a chamber and a front surface which defines a generally rectangular access opening with slotted lower corners having a lateral slot dimension which is greatest at the base of the slots and least at the top of the slots. The face plate contains a rectangular shaped door opening with rounded corners disposed in registry with the box access opening so that edge portions of the front surface of the box and an upper portion of the lower slotted corners project behind and within the door opening to form a lip extending substantially around the door opening against which a door may shut into said face plate. The door contains a pair of flat L-shaped hinges which are attached to lower corner portions of the door which project across corner portions of the door opening and contain lateral extensions on their free ends which seat within a lower portion of the slotted corners when the door is closed in the face plate and project into the chamber and laterally against the interior front box surface on either side of the slotted openings to hold the door in a horizontal position to form a platform when the door is open.

13 Claims, 10 Drawing Figures

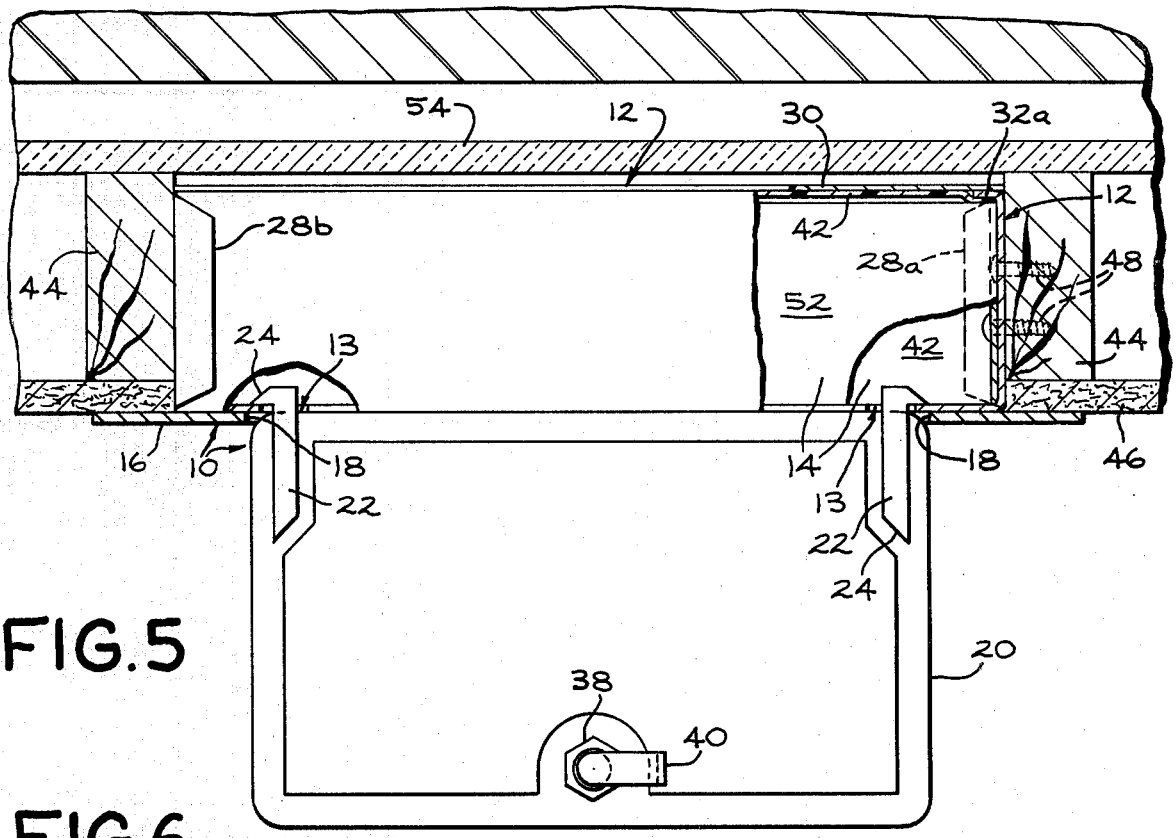
FIG.5
FIG.6
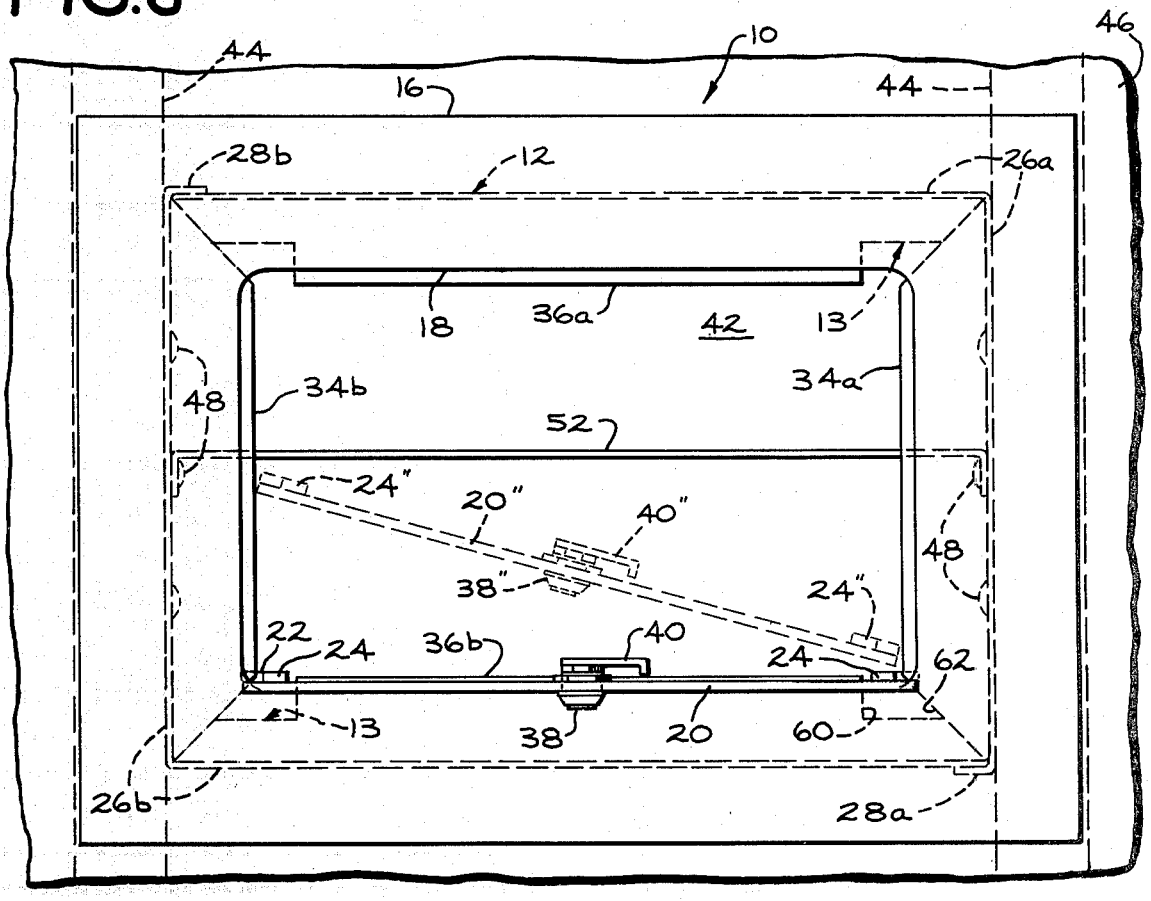

WALL SAFE AND DOOR HINGING MEANS THEREFOR

BACKGROUND OF THE INVENTION

This invention relates generally to a wall safe for the convenient and secure storage of valuables therein and to means for hinging of the access door of such a wall safe to its door opening defining surfaces. More specifically, this invention relates to a wall save having a box adapted to fit between the wall studs of a building and having a flat, rectangular shaped face plate with projecting edge portions which extend across or nearly across the front edges of the wall studs.

Wall safes adapted for placement between adjacent wall studs of a building have long been known in the prior art, generally speaking. See, for example, U.S. Pat. No. 1,644,410 issued to S. L. Belknap on October 4, 1927 which discloses a wall safe adapted to fit snugly between two wall studs of a building and having a box or receptacle for valuables attached to the studs by means of wood screws driven through its side walls. Note the relative ease with which a burglar could wedge a crowbar, claw hammer or other suitable tool between a side of the reference receptacle and the adjacent wall stud to rip the safe free from its mounting. This problem had been somewhat overcome previously as shown in U.S. Pat. No. 264,172 issued to J. H. Laskey on Sept. 12, 1882 in which he disclosed a wall safe for railway cars having a receptacle or box for storage of valuables closely fitted between vertical timbers in the walls of a car, which box contains a front flange projecting beyond the vertical sides of the box across or nearly across the front surface of the box confining timbers. The flange is bolted from the front into the box confining timbers at several places to secure the assembly. The obvious problem here is the accessibility of the bolt heads and the ease with which a burglar can remove them with the appropriate tool to thus remove the safe assembly from the railroad car wall.

My invention substantially overcomes these and other difficulties in the construction of wall safes and their door hinging means which have previously existed in the prior art.

SUMMARY OF THE INVENTION

Briefly, in accordance with the objects and features of my invention, I provide a wall safe which includes a rectangular box defining a storage chamber and an access opening in a front surface of the box communicating with the chamber. The box is adapted to fit relatively closely between adjacent vertical wall studs of a building. Fastening means is provided for securing the vertical sides of the box to the wall studs. A rectangular shaped face plate is attached to the front surface of the box and defines a door opening therein which is disposed in registry with the access opening. The face plate contains boltless edge portions which extend beyond the sides of the box across at least a major portion of the front surface of the wall studs. A door is hingably connected to the box for closing in close fitting relation in the door opening.

Additional objects, features and advantages of my invention will become apparent to those skilled in the art from the following detailed description of the invention and attached drawings upon which, by way of example, only a preferred embodiment of the present invention is illustrated.

BRIEF DESCRIPTION OF THE DRAWINGS

FIG. 5 shows top plan view of the wall safe of FIG. 1 with certain parts broken away to show internal construction and with the wall safe door shown in a lowered, open position.

FIG. 6 shows a front elevation view of the wall safe of FIG. 1 with the door in a lowered, open position and illustrating in phantom how the door may be raised and tilted by hand from its open position for removal from the rest of the assembly.

DESCRIPTION OF THE PREFERRED EMBODIMENTS

Figure 1:
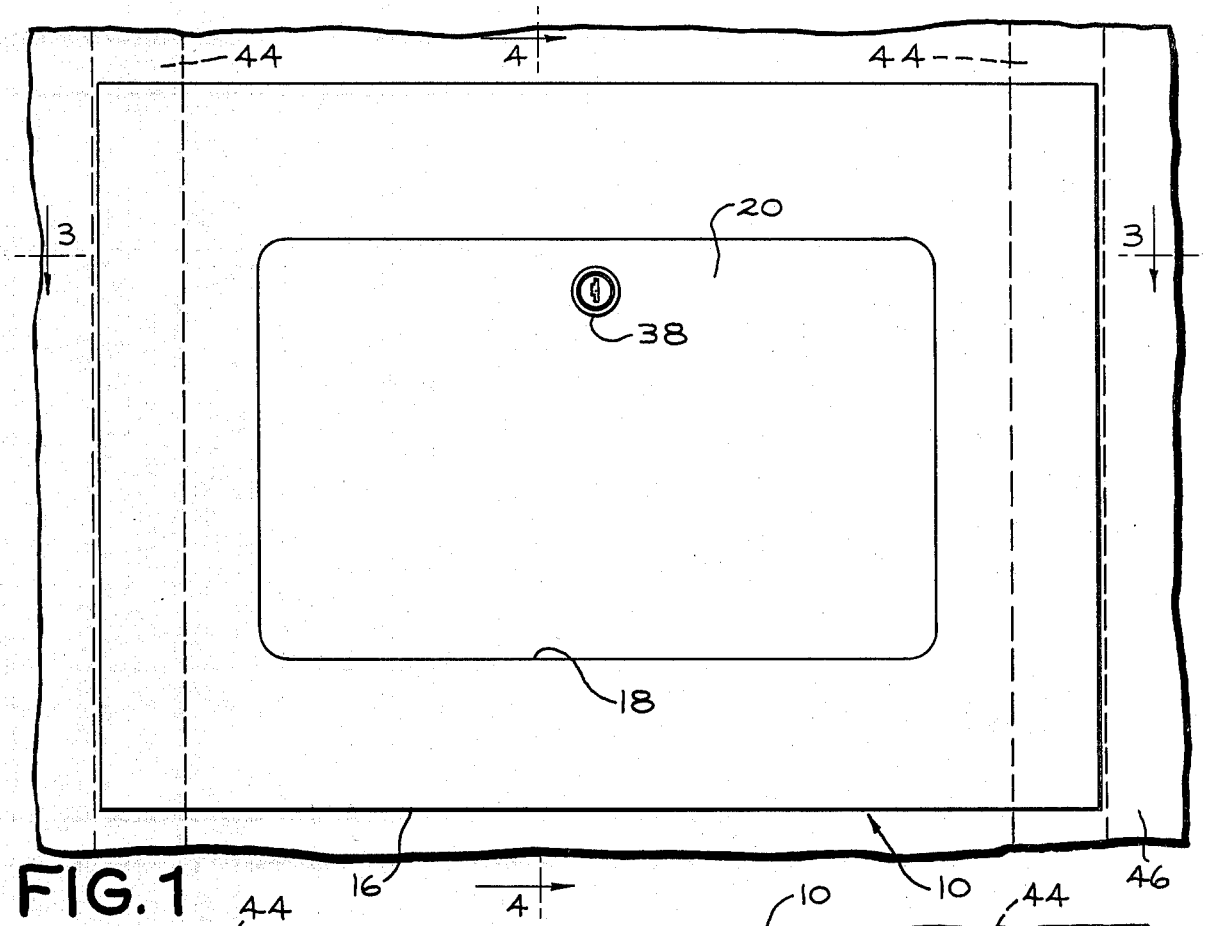
FIG. 1 shows a front elevation view of a wall safe confined between wall studs, thus illustrating one preferred embodiment of my invention.
Figure 2:
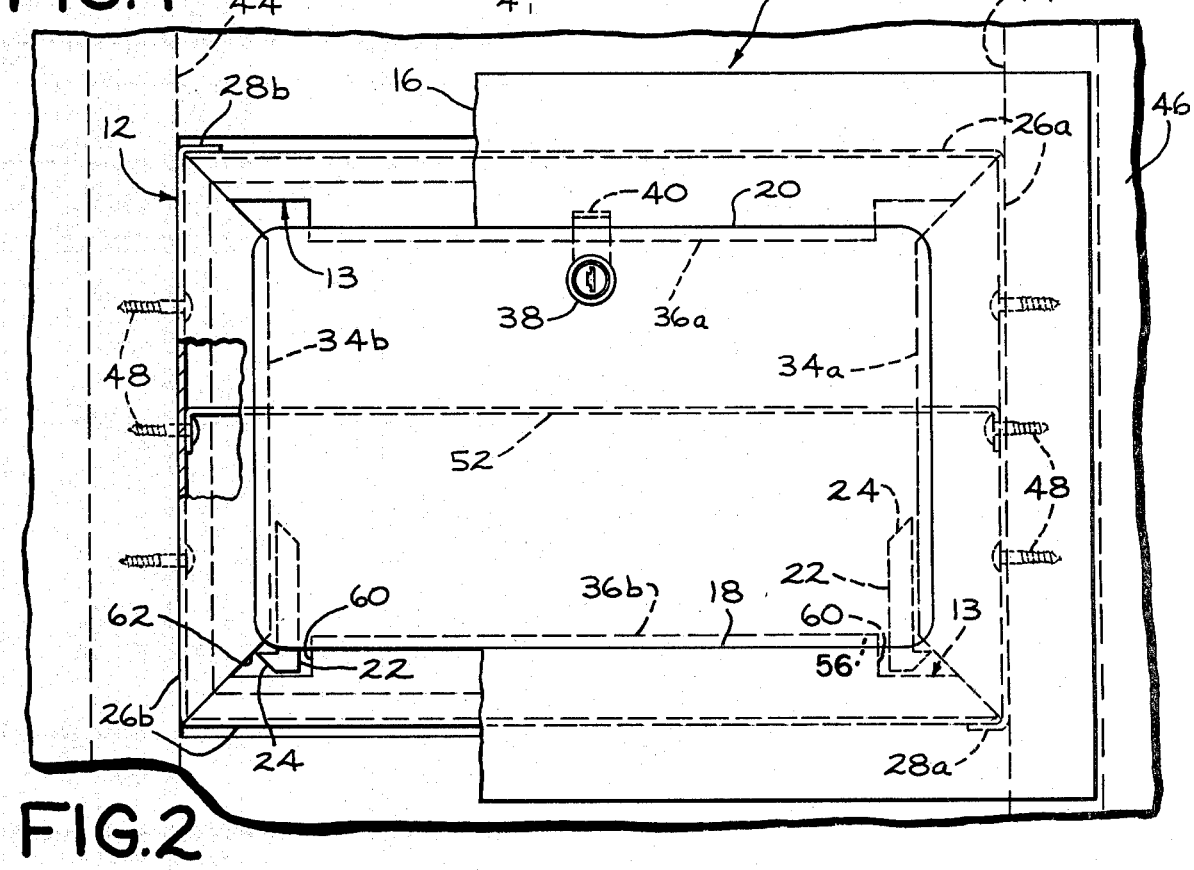
FIG. 2 shows a front elevation view of the wall safe of FIG. 1 with certain parts being broken away to show internal construction.
Figure 3:
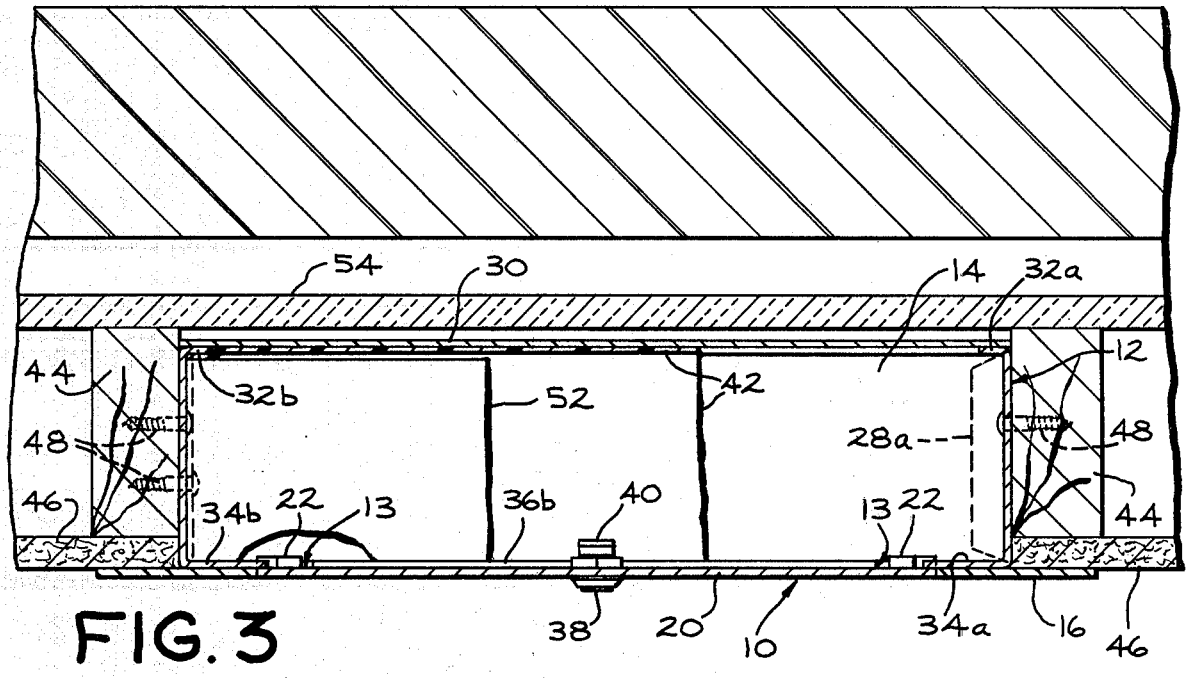
FIG. 3 shows a cross-sectional plan view of the wall safe of FIG. 1 as viewed along cross-section lines 3—3 of the latter figure.
Figure 4:
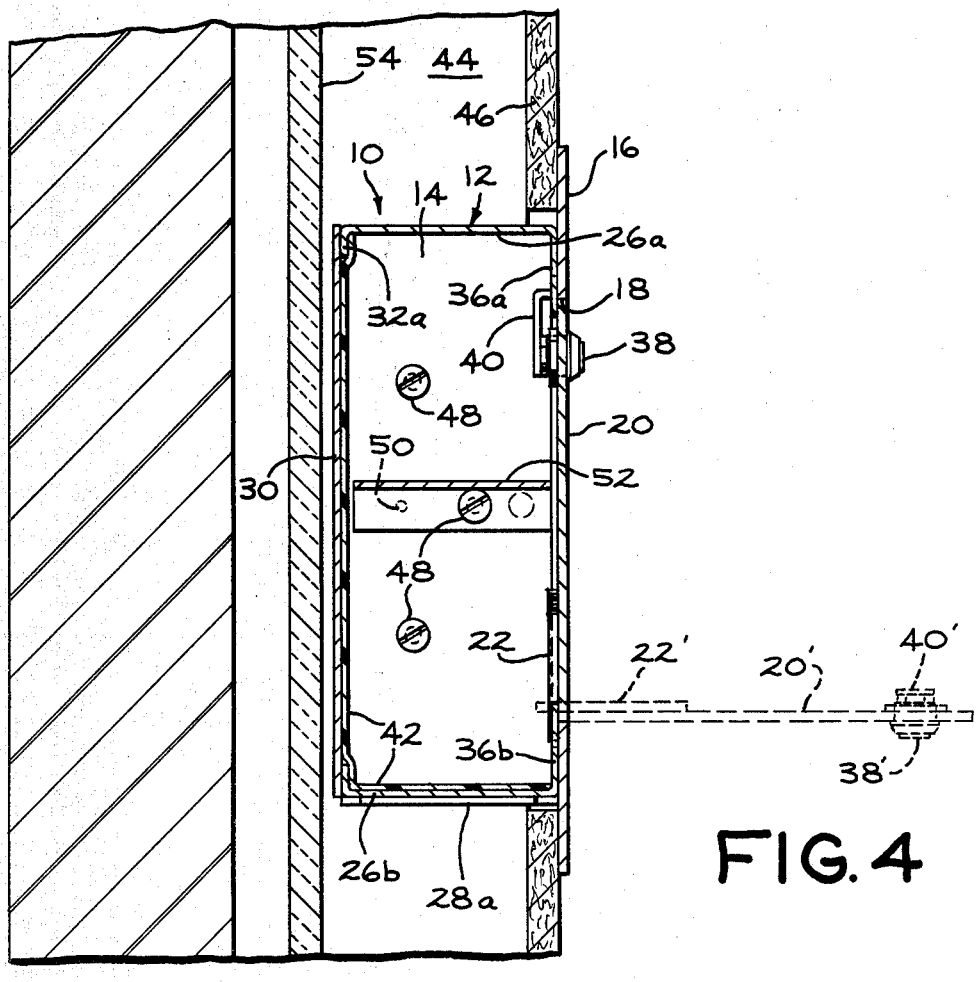
FIG. 4 shows a cross-sectional side elevation view of the wall safe of FIG. 1 as viewed along cross-section lines 4—4 of the latter figure.

Referring now to FIGS. 1–6, there is shown in one preferred embodiment of my invention a wall safe 10 adapted for use in various types of buildings and particularly in private dwellings for the secure and convenient storage of valuables such as jewelry and personal effects, money, documents and the like.

The safe 10 includes a box 12 having a generally rectangular frontal access opening with slotted corners 13 communicating with a storage chamber 14. A rectangular face plate 16 is attached to the front surface of the box 12 and has edge portions which extend substantially beyond the top, bottom and side surfaces of the box 12. The plate 16 contains a rectangular access opening 18 with rounded corners, which opening is aligned in registry with the opening in the front surface of the box 12. A door 20 closely fits within the opening in the face plate 16 when in the closed and locked position (see FIGS. 1–4) and tilts downwardly to a horizontal position to form a convenient platform as at 20′ when in the open position (see FIGS. 4–6). A pair of flat L-shaped hinges 22 having tapered ends 24 are attached to lower inside corner portions of the door 20 and project into the lower slotted corners 13 in the access opening of the box 12. It is preferable that the thickness of the hinges 22 be at least as great or greater than the thickness of the material of the face plate 16 which defines the slotted openings 13 to insure a stable and secure fit between them when the door 20 is in the closed and locked position. In the present example, it will be noted that the hinges 22 are slightly thicker than the material defining the slotted openings 13. The box 12, face plate 16 and door 20 should be constructed of suitably rigid, strong, durable material such as a heavy gauge sheet metal. I recommend using #16 gauge sheet metal for construction of the box 12 and #10 gauge sheet metal for construction of the face plate 16 and door 20.

In the safe 10 of the present example, I construct the box 12 using two generally L-shaped members 26*a–b* welded together at tabs 28*a*, 28*b* in the lower right-hand corner and upper left-hand corner, respectively. The tab 28*a* is a trapezoidally shaped extension of the lower end of right side of the box 12 bent at a right angle to the vertical side so as to overlap the bottom portion of the member 26*b* which forms the bottom of the box 12. Similarly, the tab 28*b* is a trapezoidally shaped extension of the upper end of the vertical side of member 26*b* bent at a right angle so as to overlap the upper side of the member 26*a* which forms the top of the box 12. The back of the box 12 consists of a flat rectangular plate 30 which may be welded along its edge portions to edge portions 32*a–b* of the members 26*a–b*, respectively, such edge portions being bent at right angles to the upper, lower and side surfaces of the members 26*a–b* and mitered at the rear corners of the box 12 where adjacent ends of the vertical and horizontal edge portions 32*a–b* meet.

The frontal surface of the box 12 against which the plate 16 is welded or otherwise adjoined is formed, in part, by bending trapezoidally shaped extended front edge portions 34*a–b* of the members 26*a–b* at right angles to the vertical sides of the box 12 and, in part, by bending trapezoidally shaped extended front edge portions 36*a–b* of such members, containing slotted corners 13 therein, at right angles to the upper and lower surfaces of such members. The door 20 contains a key-operated lock 38 of conventional type which places an L-shaped catch 40 against the inside surface of the box edge portion 36*a* when in the locked position (See FIGS. 2–4) and rotates the catch 40 90 degrees to clear the edge portion 36*a* and allow the door 20 to be tilted downwardly when in the unlocked position (See FIGS. 4–6). A combination or other suitable type of lock can be substituted for the lock 38 as desired.

A sheet 42 of asbestos cloth or other suitable heat resistant material may be disposed in the storage chamber 14 so as to extend over the floor and back thereof for protecting the contents of the box 12 against fire. The outside dimensions of the box 12 should be such that it will fit relatively closely between adjacent wall studs 44 such as can be found in the walls of most homes, apartments and similar buildings. Since standard spacing between adjacent 2×4 wall studs is usually about 14½ inches, I recommend making the length of the box 12 no greater than 14 inches. A rectangular opening may then be cut in the dry wall or other wallboard 46 in front of and between the studs 44 where it is desired to mount the safe 10 after which the box 12 is inserted through the dry wall opening between the studs 44 and secured to the latter by means of wood screws 48 or other suitable threaded fasteners. While I provide three vertically-arranged holes in the sides of the box 12 for wood screws 48, I recommend placing the middle hole out of direct vertical alignment with the upper and lower hole to guard against causing the wood of the studs 44 to split when the screws 48 are inserted and, in particular, when a burglar attempts to yank the box 12 from between the studs 44. A small nail hole 50 (See FIG. 4) may also be provided in the sides of the box 12 adjacent the middle screw hole to allow the box 12 to be aligned by hand between the studs 44 and temporarily secured while the wood screws 48 are being inserted.

As an additional feature of the safe 10 of my invention, I provide a shelf 52 which may be inserted into the chamber 14 and secured by means of the middle wood screws 48 to the sides of the box 12. The depth of the box 12 should be slightly less than 4 inches, i.e. 3½ inches, so that when inserted between the studs 44 with the extended edge portions of the face plate 16 flush against the dry wall 46, the rear plate 30 will not be forced against a sheet of insulating material 54 which will usually be found attached to the back of the studs 44. Thus, I recommend the dimensions of the box 12 be 14 inches long, 3½ inches deep and 9½ inches high. A reasonable door size of 11½ inches by 7 inches is recommended and the edge portions 34*a–b* and 36*a–b* should be such as to provide about ¼ inch of lip 56 projecting behind but within the door opening in the face plate 16 substantially around its entire margin so that the door 20 will mount flush against the lip 56 when in the closed and locked position. Referring now particularly to FIG. 6, the door 20 can readily be removed from access opening in the face plate 16 by first unlocking and lowering the same to its horizontal open position and thereafter tilting the door 20 as shown at 20″ until the hinges 24 as shown at 24″ clear the lips 56 of the edge portions 34*a–b*.

For security purposes, the face plate 16 should have a horizontal dimension such that, when the box 12 is inserted through the opening in the dry wall 46 between the studs 44, its side edge portions extend across or nearly across the front edge of both of the studs 44. Because the face plate 16 is boltless and merely fits flush against the dry wall in front of the studs 44 against which the box 12 is attached, prying or wedging behind the extended edge portions of the face plate 16 with a crowbar or other tool will not result in removal of the safe 10 from the wall in most cases. I recommend that the dimensions of the face plate 16 be about 17 inches across by 12 inches high. It will also be noted that it is unnecessary to apply the asbestos cloth 42 to the interior vertical sides of the chamber 14 within the box 12 since the wall studs 44 immediately adjacent the box sides will protect the sides of the chamber 14 from direct flame in the event of fire.

Figure 7:
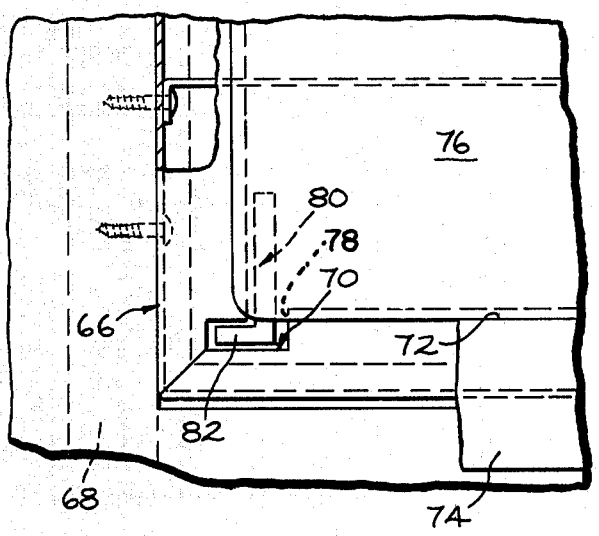
FIGS. 7–8 show fragmented front elevation and plan views, respectively, of a lower corner portion of a wall safe with certain parts removed, thus illustrating alternative door hinge arrangement and another preferred embodiment of my invention.
Figure 8:
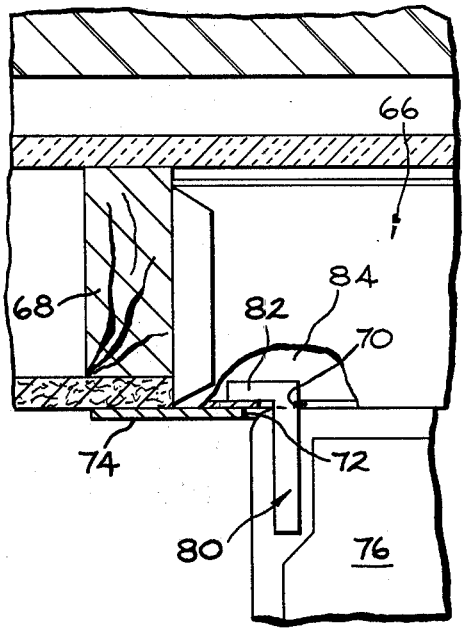

Referring now to FIGS. 7–8 there is shown, in a second preferred embodiment of my invention, an alternative door hinging arrangement for a wall safe. Accordingly, there is shown a rectangular shaped article receptacle or box 66, adapted for relatively close confinement between a pair of wall studs 68 (only one of which need be shown) in the same manner as the box 12 of the previous example. Further, the box 66 is of generally the same construction as the box 12 of the previous example with the exception of a pair of slots 70 (only one of which is shown) located below and opening at their upper ends into portions of the lower corners of a rectangular access opening formed in a front surface of the box 66. As in the previous example, a rectangular door opening 72 having rounded corners is formed in a rectangular face plate 74 attached to the access opening defining front surface of the box 66. The opening 72 contains a door 76 and is of somewhat greater horizontal and vertical dimension than the access opening with which it registers so that a lip or jamb 78 is formed behind the door opening 72 around substantially the entire perimeter thereof to act as a stop against which the door 76 rests when closed.

A pair of flat, L-shaped hinges 80 are attached to lower corner portions of the door 76 in line with the slots 70 and extend beyond the lower edge of the door 76 so that laterally extending free ends 82 of the hinges 80 seat within enlarged lower portions of the slots 70 for confinement therein when the door 76 is closed (see FIG. 7) and so that the ends 82 tilt upwardly out of the lower portions of the slots 70 into contact with the back of the front surface of the box 66 within a chamber 84 as the door 76 is lowered to its open, horizontal position (see FIG. 8). Note that the enlarged base portion of the slot 70 adapted to confine the hinge end 82 (FIG. 7) is entirely below the lower margin of the door opening 72 so that, as the door 76 is tilted downward to the open, horizontal position as shown in FIG. 8, a lower portion of the leg of the hinge 80 which is attached to the door 76 rests upon the margin and projects through a relatively narrow upper end portion of the slot 70 between adjacent edges of the jamb 78.

Figure 9:
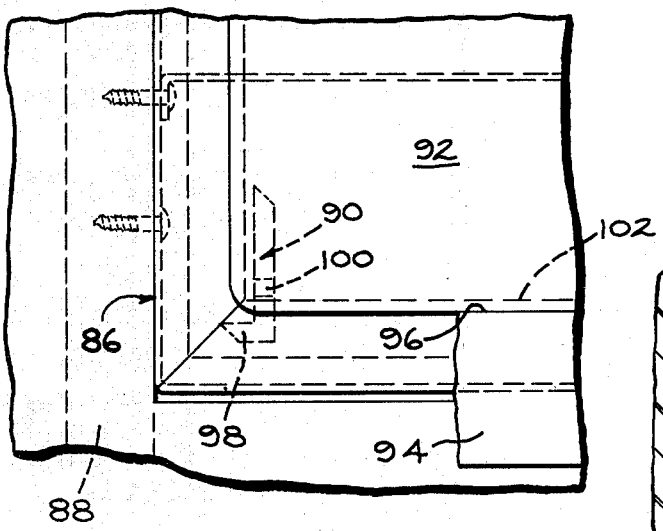
FIGS. 9–10 show fragmented front elevation and side elevation views, respectively, of a lower front corner portion of a wall safe with certain parts removed, thus illustrating another alternative door hinge arrangement and preferred embodiment of my invention.
Figure 10:
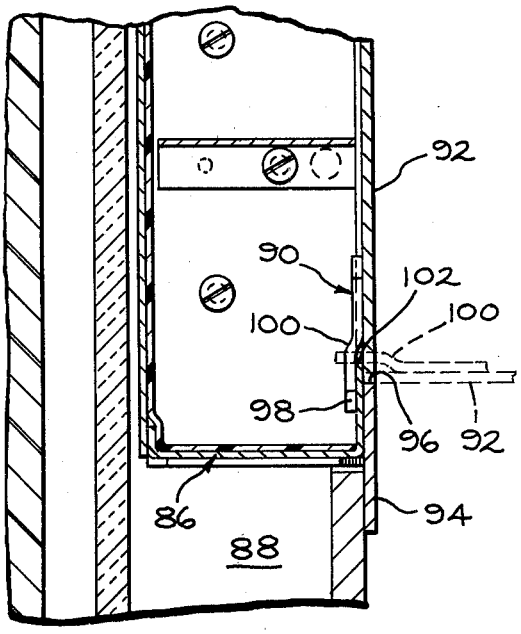

Referring now to FIGS. 9–10 there is shown, in a third preferred embodiment of my invention, a door hinge arrangement for a wall safe which includes a box 86 of generally the same hollow rectangular construction as the boxes 12 and 66 of the previous examples adapted for close confinement between a pair of wall studs 88 (only one of which need be shown). In this example, it will be noted that the access opening formed in a front surface of the box 86 is rectangular and there are no corner slots provided therein. A pair of flat, L-shaped hinges 90 are provided and welded or otherwise fastened to lower corner portions of a door 92. A rectangular face plate 94 having a rectangular door opening 96 formed therein is attached to a front access opening defining surface of the box 86. As in the previous examples, the hinges 90 contain lateral extensions 98 on their free ends adapted to catch against the sides of the front surface of the box 86 to hold the door 92 in an open, horizontal position. However, since there are no slots to confine the extensions 98 therein when the door 92 is raised to its closed position in the face plate 94, a central portion of the hinge 90 must be bent as at 100 so as to follow over the top of a door jamb 102 and lie flat against the back of the frontal surface of the box 86 when the door 92 is closed (see FIG. 10). Note that when the door 92 is in its horizontal, open position, a lower end portion of the hinge 90 rests upon a lower margin of the jamb 102 rather than within the upper end portion of a slot in the jamb as was the case in the previous examples.

Although the present invention has been described with respect to specific details of certain preferred embodiments thereof, it is not intended that such details limit the scope of my invention otherwise than as set forth in the following claims.

I claim:

1. A wall safe comprising a rectangular box defining a storage chamber and an access opening in a front surface of said box communicating with said chamber, said box being adapted to fit relatively closely between adjacent vertical wall studs of a building, fastening means for securing the vertical sides of said box to said wall studs, a rectangularly shaped face plate attached to said front surface and defining a door opening therein disposed in registry with said access opening, said face plate having boltless edge portions which extend beyond said box sides across at least a major portion of the front surface of said wall studs, a door hingably connected to said box for closing in close fitting relation to said door and for opening into a horizontal position in front of the lower margin of said door opening to form an article supporting platform, and a pair of L-shaped hinges fixedly attached along one leg portion thereof to a lower corner portion of said door, the other laterally projecting leg portions thereof extending beyond the lower edge of said door behind said face plate and against a wall defining a front surface of said chamber when said door is closed in said door opening, said laterally projecting leg portions extending behind and against vertical edge portions of the access opening defining front wall of said box to thus support said door in a horizontal position when said door is open to form said platform.

2. The wall safe of claim 1 wherein said L-shaped hinges are flat, said access opening being generally rectangular in shape and containing slotted openings in lower corners of said access opening adapted to receive said laterally projecting leg portions of said hinges therein when said door is closed in said door opening.

3. The wall safe of claim 2 wherein said slotted openings are tapered so that their lateral dimensions decrease moving upward from the lower to the upper ends of said slotted openings, upper portions of said slotted openings being slightly above the lower corners of said door opening, said L-shaped hinges projecting across bottom corner portions of said door opening and through said upper portions of said slotted opening when said door is in an open horizontal position, said hinges containing free ends which extend laterally in said chamber away from said upper portions behind said front surface of said box to hold said door in said horizontal position when unlocked and open, said free ends being tiltable downwardly into enlarged lower portions of said slots when door is raised into closing relation with said door opening.

4. The wall safe of claim 1 further comprising a sheet of heat resistant material applied to a floor and rear wall of said box in said chamber.

5. The wall safe of claim 1 further comprising a shelf disposed in said chamber and fixedly connected to said box sides.

6. The wall safe of claim 1 wherein said door opening is slightly larger than said access opening whereby access opening defining end portions of said box front surface form a lip which extends substantially around and behind the perimeter of said door opening to form a stop against which said door will shut when said door is placed in a closed position in said door opening.

7. The wall safe of claim 1 wherein said box comprises a pair of generally L-shaped members, each of said members forming a vertical and horizontal side of said box and a vertically and horizontally extending edge portion of said front surface, said members being joined together by means of tabs at two diagonally opposite corners of said box.

8. The wall safe of claim 7 further comprising a flat rectangular plate attached to rear edge portions of said members which are bent at right angles to the upper, lower and side surfaces of said members and mitered at the corners of the box where adjacent ends of the vertical and horizontal rear edge portions meet.

9. The wall safe of claim 1 wherein a central portion of each attached leg portion of said L-shaped hinges is bent on a central portion thereof, said other laterally projecting leg portions of said hinges fitting against a back of said front surface below the lower margin of said access opening when said door is in a closed position in said door opening, sides of said laterally projecting leg portions fitting against the back sides of said front surface beyond the side margins of said access opening when said door is in an open, horizontal position.

10. A wall safe comprising a rectangular box defining a storage chamber therein and having a generally rectangular shaped access opening formed in a front surface of said box and communicating with said chamber, said front surface also containing slots in the lower corners of said access opening whose laterally inner sides are vertical and whose laterally outer sides are slanted, said slots opening at their upper ends at the level of their least lateral dimension into lower corner portions of said access opening and extending downwardly beneath the lower lateral margin of said access opening to the level of their greatest lateral dimension at the base of said slots, a rectangular face plate attached to the access opening and slot defining front surface of said box and defining a generally rectangular door opening with rounded lower corners, said door opening being disposed in registry with said access opening and flush therewith and being of such lesser vertical and lateral dimension than that of said access opening that edge portions of the access opening defining front surface of said box form a jamb substantially around the entire perimeter of said door opening against which a door closed into and closely conforming with said door opening will rest, upper end portions of said slots at and near the level of their least lateral dimensions projecting above the lower lateral margin of said door opening above lower corner portions thereof, a door having a generally rectangular shape with rounded corners conforming to and adapted to relatively closely fit into said door opening, said a pair of relatively flat L-shaped hinges attached to lower edge portions of said door on corner edge portions thereof in line with said slots, said hinges having laterally extending free ends which project beyond the lower margins of said door across and above the lower corner portions of said door opening and through the upper end portions of said slots such that said laterally extending free ends of said hinges extend laterally away from said slots toward the outer sides of said box inside of said chamber against the back of said front surface to hold said door in a horizontal position when in an open condition, said laterally extending free end portions being tiltable downwardly into base portions of said slots for confinement therein as said door is tilted upwardly from said horizontal position into a closed position in said door opening.

11. A wall safe comprising a box defining a storage chamber therein and having an access opening in a front surface thereof which communicates with said chamber, means for securing said box to a wall, a face plate attached to said front surface and defining a door opening therein disposed in registry with said access opening, a door tiltably connecting for closing into close fitting relation in said door opening and for opening into a horizontal position in front of a lower edge portion of said door and access opening to form an article supporting platform, and a pair of L-shaped hinges fixedly attached along one leg portion thereof to lower corner portions of said door, the other leg portions thereof being laterally extending free and portions which project below the lower edge of said door behind said face plate and against a wall when said door is closed in said door opening, said laterally extending free end portions being tiltable upwardly in said chamber against opposing vertical edge portions of the access opening defining front surface of said box to thus support said door in said horizontal position when said door is open to form said platform.

12. The wall safe of claim 11 wherein said L-shaped hinges are flat, said front surface having slots therein which open at their upper ends into the lower corners of said access opening, said laterally extending free end portions projecting downwardly into said slots and against a rear surface of said face plate when said door is closed in said door opening.

13. The wall safe of claim 11 wherein a central portion of the legs of said L-shaped hinges which are attached to said door are bent such that the lower end portions of said hinges which extend beyond the lower edge of said door are spaced above the surface of said door to extend across the corners of said access opening into said chamber when said door is in a horizontal open position and such that said laterally extending free end portions engage against a chamber defining surface of said front surface below the corners of said access opening when said door is closed in said door opening.

* * * * *